United States Patent [19]

Keenan et al.

[11] Patent Number: 4,462,574

[45] Date of Patent: Jul. 31, 1984

[54] METHOD FOR MINIMIZING SLAG CARRYOVER

[75] Inventors: William M. Keenan, Pittsburgh; Sheldon McGarry, Penn Township, Westmoreland County; James G. Bassett, Jr., Franklin Township, Westmoreland County, all of Pa.

[73] Assignee: United States Steel Corporation, Pittsburgh, Pa.

[21] Appl. No.: 506,557

[22] Filed: Jun. 21, 1983

Related U.S. Application Data

[63] Continuation of Ser. No. 376,800, May 10, 1982.

[51] Int. Cl.[3] ..... C21C 5/46

[52] U.S. Cl. ..... 266/45; 266/230; 266/272; 222/590; 222/597

[58] Field of Search ..... 266/45, 230, 272; 222/590, 591, 597

[56] References Cited

U.S. PATENT DOCUMENTS 2,718,389 9/1955 Perrin ..... 266/230

FOREIGN PATENT DOCUMENTS 52-4042305 10/1977 Japan .

330196 4/1972 U.S.S.R. ..... 266/230

590340 2/1978 U.S.S.R. ..... 266/230

*Primary Examiner*—L. Dewayne Rutledge

*Assistant Examiner*—S. Kastler

*Attorney, Agent, or Firm*—William F. Riesmeyer, III

[57] ABSTRACT

The invention is of a method for minimizing slag carryover when draining molten metal from a furnace and an article for use in the method. This article is a polyhedral-shaped body having density intermediate that of the slag and metal. When thrown onto the surface of the slag within a restricted area over the taphole, the body will float at the slag-metal interface, and tend to lodge with one of its corners projecting into the taphole as the final portion of remaining metal drains out of the furnace. The shape of the body and its dimensions are selected so as to only partially block the taphole opening, causing flaring of the stream so as to signal a furnace operator of the impending flow of slag from the furnace. The operator then shuts off flow to prevent carryover of slag onto the molten metal already tapped. Since only the edges of the body contact the taphole of the body does not become welded to the wall of the taphole and therefore is easily dislodged without loss of time between heats.

5 Claims, 2 Drawing Figures

METHOD FOR MINIMIZING SLAG CARRYOVER

This is a continuation of application Ser. No. 376,800, filed May 10, 1982.

BACKGROUND OF THE INVENTION

This invention relates to a method for minimizing slag carryover during tapping of molten metal from a furnace, and to an article for use in the method.

It is desirable in order to improve ladle addition recoveries and deoxidation control in steelmaking to minimize carryover of slag with the molten metal as it is tapped from the furnace. Various stopper devices have been used for plugging the taphole of BOP and Q-BOP furnaces to prevent drainage of slag at the beginning of tap when the furnace is first tilted downward to drain the metal out. However, most of the slag gets into the ladle as a result of becoming entrained with the metal in a vortex which forms at the taphole entrance as the final portion of metal is drained from the furnace.

Two different approaches have been made toward solving this latter problem. In one, a device located on the exterior of the furnace is actuated to physically cut off the stream as slag begins to flow out of the taphole. A second approach has been to insert a floatable device into the furnace which acts as a stopper becoming lodged in the taphole. These latter devices float at the slag-metal interface and tend to prevent formation of a vortex, thus decreasing slag entrainment. However, the floatable stoppers have the disadvantage that they tend to weld to the wall of the taphole and are difficult to dislodge, requiring burning with an oxygen lance and causing loss of time between heats. This also increases wear on the taphole itself. Examples of prior floatable stoppers are shown in Stahl Und Eisen, Volume 90, pages 257–263 and Japanese Patent Application No. J47-20803.

It is the primary object of this invention to overcome the disadvantages of the above-mentioned prior art and to provide an improved floatable device for minimizing slag carryover from a furnace during tapping of molten metal therefrom and a method for use of the new device.

SUMMARY OF THE INVENTION

According to this invention a polyhedral-shaped body is provided having a density intermediate that of slag and metal so as to float at the interface thereof when inserted into a furnace. For use in steelmaking a density of 0.12 to 0.22 pounds per cubic inch is preferred. The body is of material substantially indissoluble in the molten metal and slag. It has a plurality of generally planar faces, the intersections of which are adapted to lodge in the taphole without completely blocking the opening therein. The dimensions of the body are, at minimum, greater than the maximum cross-sectional dimensions of the taphole. The body has a maximum dimension in any direction of not more than twelve inches (12"). It has a volume within the range of 64 to 1728 cubic inches and is adapted to block between 20 and 80 percent of a round taphole opening having a diameter between four and ten inches when an intersection of the faces of the body is lodged centrally therein. Thus, when the final portion of metal starts to flow out of the furnace, the body will tend to lodge in the taphole, causing the stream to flare since the hole is only partially blocked. The flaring stream acts as a signal to a furnace operator that slag will start to flow soon. Thus, the operator may shut off flow, preventing slag carryover onto the metal in the ladle. A primary advantage of the polyhedral-shaped device is that it does not become permanently lodged in the taphole and does not require burning with an oxygen lance in order to remove it from the taphole.

The body may have faces all of the same shape and size. A cuboid shape is preferred. The body may be of refractory material having solid metal particles distributed therein to increase its density. The metal particles may be shot or fibers, the latter serving to increase cohesiveness of the body. Preferably, carbon steel shot is used whereas the fibers are of stainless steel composition.

The method involves inserting the body into the furnace, draining molten metal from the furnace, monitoring the stream emanating from the taphole during draining so as to obtain an indication of flaring when the body lodges in the taphole, and then shutting off flow to prevent slag carryover onto the molten metal drained from the furnace.

DESCRIPTION OF THE PREFERRED EMBODIMENT

Figure 1:
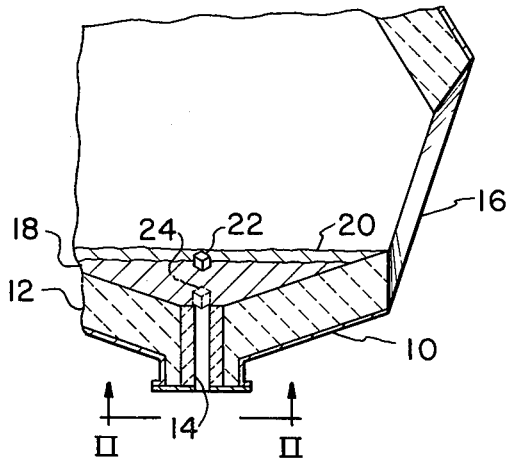
FIG. 1 is a cross-section of a furnace tilted into tapping position for draining molten metal through a taphole of the furnace and showing the location of the apparatus of this invention during the tapping operation.
Figure 2:
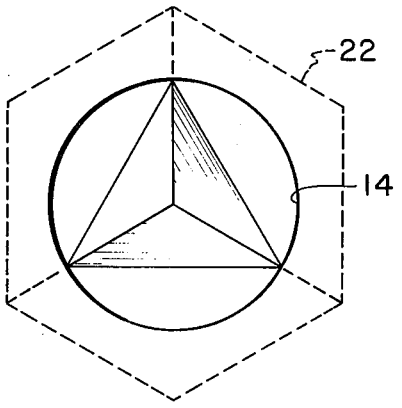
FIG. 2 is a schematic illustration of how the apparatus of this invention lodges in the furnace taphole during the final stage of the tapping operation.

Referring to FIG. 1, a conventional steelmaking converter 10 is shown having a refractory lining 12 and taphole 14 located near the mouth 16 of the converter vessel. The vessel is shown tilted downwardly from its normal upright position, so that molten metal 18 and slag 20 will drain therefrom. The apparatus of this invention comprises a cube 22 shown floating at the slag-metal interface during tap. Referring to FIG. 2, the cube 22 is shown lodged in the taphole 24 only partially blocking the taphole opening. For a six-inch (6") diameter taphole, a cube 7 or 8 inches on each face has been found to work satisfactorily. A seven-inch (7") cube is preferred. It will block about 40 percent (40%) of the cross-section of a six-inch (6") diameter taphole.

The cubes may be of any refractory material resistant to dissolution in the metal and slag, at least sufficiently to maintain minimum dimensions necessary for lodging in the taphole. Castable refractory is preferred. We have used seven-inch (7") cubes having a density of from 0.15 to 0.17 lbs/in.$^3$, although any density between that of the slag and metal should suffice. For example, molten steel has a density of about 0.25 lbs/in.$^3$, whereas steelmaking slags have density of about 0.10 lbs/in.$^3$. Shown below are examples of mixtures used for making typical cubes:

TABLE I

| | Weight in lbs. |
|---|---|
| CUBE A 7-inches on each face with density of 0.15 lbs./in.$^3$ | |
| Refractory Cement | 7.6 |
| Fine Iron-Ore Concentrate | 15.2 |
| Steel Shot | 28.6 |
| Water | 2.5/4.0 |

TABLE I-continued

| | Weight in lbs. |
|---|---|
| Stainless Steel Fibers | 1.5 |
| CUBE B 7-inches on each face with density of 0.17 lbs/in.$^3$ | |
| Refractory Cement | 5.2 |
| Fine Iron-Ore Concentrate | 10.4 |
| Steel Shot | 42.7 |
| Water | 2.5/3.0 |
| Stainless Steel Fibers | 1.5 |

The steel shot is of conventional type readily available and is used for adding to the density of the cube. Iron ore is used since it reacts with carbon in the steel bath and indicates where the submerged cube is located. The stainless steel fibers tend to bind the refractory preventing the cube from breaking apart prematurely. Of course, it is desirable to completely dry the cubes in order to remove moisture which reacts with the metal, causing the cubes to crack and break.

It is essential that the cube be dropped into a restricted area over the taphole so as to assure its being carried by fluid currents in the metal during tap into an area directly over the taphole so that it will lodge therein. It has been found that the angle of downward tilt of BOP or Q-BOP furnace at the end of tap, if tilted so as to obtain the maximum rate of draining metal, varies from about 88° to 103° from vertical. The range of angles is due to various factors such as erosion of the furnace lining during a campaign and slag or skull buildup at the furnace mouth. We have found that reasonable estimates of the location of the taphole can be made by calculating the horizontal distance of the taphole from the furnace trunnions for various angles of tilt of the furnace. The location of the taphole from the trunnions at the end of tap will vary over a campaign about four feet (4'). Thus it has been found best to insert the cube in the middle of the calculated four-foot (4') distance. This can be accomplished by various means from floor level at a location adjacent the furnace mouth.

The cube should also be inserted into the furnace just before a vortex forms as the final portion of metal starts to drain out. This time may be calculated from the estimated tonnage of metal contained in the furnace, the size and shape of the taphole in relation to metal bath so as to arrive at a critical tonnage of metal left in the furnace when vortexing will begin to occur. This critical tonnage may be calculated for conventional steelmaking BOP or Q-BOP vessels from the formula. Normally, we prefer to add the cube within a calculated time of between one to two minutes before the end of tap when all of the metal is drained from the furnace.

We claim:

1. A method of minimizing slag carryover from draining molten metal from a furnace through a taphole therein, said method comprising:

dropping a polyhedral-shaped body onto the surface of molten slag and metal in said furnace within a restricted area above said taphole so as to insure that said body will be drawn into the taphole as a final portion of metal drains out of the furnace, said body having a cross-section of minimum dimension greater than the maximum dimension of the cross-section of the opening of said taphole, said body having a density intermediate that of the molten metal and slag in said furnace, said body being substantially resistant to dissolution in the molten metal and slag so as to retain minimum cross-sectional dimensions greater than the taphole opening for a time sufficient to assure the body will lodge in the taphole opening, said body having equilateral generally planar faces, the intersections of which are adapted to lodge in the taphole without completely blocking the taphole opening, said body having dimensions for blocking between 20 to 80 percent of the taphole opening when an intersection thereof becomes lodged centrally in said taphole opening, draining molten metal from the furnace through the taphole opening, monitoring the condition of the stream emanating from said taphole so as to obtain an indication of flaring of said stream when said body lodges therein, and then shutting off flow through said taphole so as to prevent carryover of slag onto the molten metal already tapped from the furnace.

2. The method of claim 1 wherein said step of inserting the body into the furnace includes inserting the body onto the surface of said slag within a four-foot (4') diameter circle centrally located with respect to the range of taphole locations upon tilting of the furnace for maximum drain on successive heats throughout a full furnace campaign.

3. The method of claim 1 wherein said step of inserting the body is carried out at a calculated time within the range of one-to-two minutes before the end of tap when all metal has been drained from the furnace.

4. The method of claim 1 wherein said body is of cuboid shape.

5. The method of claim 1 wherein said body comprises cast refractory material having solid metal particles distributed therein, said metal particles including steel shot and stainless steel fibers.

* * * * *